US006244064B1

(12) United States Patent
Powell et al.

(10) Patent No.: US 6,244,064 B1
(45) Date of Patent: Jun. 12, 2001

(54) COMBINATION TOOLBOX-COOLER DEVICE

(76) Inventors: Arthur Powell, 1805 Roswell Rd. 34C, Marietta, GA (US) 30062; Melvin T. Willis, Sr., 5931 Bretton Woods Dr., Lithonia, GA (US) 30058; Maurice L. Monroe, 1135 Vonda La., Mableton, GA (US) 30126; Timothy L. Jackson, 2751 Salem Rd., Stone Mountain, GA (US) 30677; Benjamin Scandrett, 4137 Conley Dr., Conley, GA (US) 30288

( * ) Notice: Subject to any disclaimer, the term of this patent is extended or adjusted under 35 U.S.C. 154(b) by 0 days.

(21) Appl. No.: 09/444,876

(22) Filed: Nov. 22, 1999

Related U.S. Application Data

(60) Provisional application No. 60/109,455, filed on Nov. 23, 1998.

(51) Int. Cl.[7] ..... F25D 3/08

(52) U.S. Cl. ..... 62/457.2; 62/331

(58) Field of Search ..... 62/457.2, 457.7, 62/331; 220/523, 527

(56) References Cited

U.S. PATENT DOCUMENTS

| | | | | |
|---|---|---|---|---|
| 3,482,418 | * | 12/1969 | Moore | 62/457 |
| 4,037,081 | | 7/1977 | Aldridge et al. . | |
| 4,420,678 | | 12/1983 | Kalb . | |
| 4,866,572 | | 9/1989 | Blodgett . | |
| 4,904,848 | | 2/1990 | Colevas . | |
| 5,276,310 | * | 1/1994 | Schmidt et al. | 219/521 |
| 5,439,108 | * | 8/1995 | Lackie | 206/373 |
| 5,503,571 | * | 4/1996 | Cheslock | 439/501 |
| 5,605,056 | * | 2/1997 | Brown et al. | 62/457.4 |
| 5,660,299 | * | 8/1997 | Harvey | 220/524 |
| 5,833,065 | * | 11/1998 | Burgess | 206/373 |

* cited by examiner

*Primary Examiner*—William Doerrler
*Assistant Examiner*—Melvin Jones
(74) *Attorney, Agent, or Firm*—Hughes & Kaplan; Barry E. Kaplan, Esq.

(57) ABSTRACT

A tool box section and a cooler section are integrally formed as one device. The toolbox portion is a typical tool box having a plurality of stacking tool trays with a latching means for securing said trays together. The stacked and latched tool trays thereby form the upper portion of the toolbox section. The lower portion forms a rectangular box having an open face and a half open top. Carried by approximately half of the lower portion, in the open top area, are a plurality of sliding tool drawers that slide open through the open face of the lower portion of the toolbox section. Carried by approximately the other half of the lower portion is the cooler section. The cooler section comprises a hinged lid having a cavity opposite the hinged end for inserting fingers to facilitate lifting of the lid. The cooler section slides in and out of the lower portion via a well known means such as a tongue-and-groove, protrusion-and-track, or wheel-and-track arrangement.

14 Claims, 4 Drawing Sheets

COMBINATION TOOLBOX-COOLER DEVICE

RELATED APPLICATIONS

The inventors hereof claim priority under U.S. Provisional Patent Application Serial No. 60/109,455, filed Nov. 23, 1998.

FIELD OF THE INVENTION

The present invention relates generally to tool cases and, more specifically, to a combination toolbox and cooler device.

BACKGROUND OF THE INVENTION

Almost any manual labor task or job requires the use of some type of tool. In fact, for almost all craftsmen and apprentice, tools are a means to an end, and as such, are essential to properly perform the desired tasks. However, one tool is typically not sufficient. To the contrary, electricians, mechanics, carpenters, and the like are well known for having a multitude of tools to ensure that any task within their respective trade can be properly performed. As a result, a plurality of toolboxes and tool cases for carrying these tools have been invented. In addition to the need for carrying tools, many craftsmen and apprentice work in remote or temporary locations that do not have adequate facilities for maintaining cold food and beverages. In other words, many work environments lack adequate refrigeration to keep and temporarily store food and beverages. As a result, many workmen dangerously risk ingestion of spoiled food or severely limit their choices to selections not requiring refrigeration.

In an attempt to overcome some of these problems, workmen will typically carry a separate cooler/lunch box for the purpose of maintaining there food and beverages at a safe and enjoyable temperature. A variety of cooler arrangements have been purposed for this purpose. Examples of such attempts may be found by reference to U.S. Pat. No. 4,904,848 to Colevas, U.S. Pat. No. 4,866,572 to Blodgett, U.S. Pat. No. 4,420,678 to Kalb, and U.S. Pat. No. 4,037,081 to Aldridge et al. However, these devices do not solve the problems at issue; that is, having to carry both a toolbox and a lunch box/cooler to a worksite and, thus, requiring the use of both hands, thereby limiting the ability to carry other necessary items.

It is readily apparent that a new and improved toolbox/cooler combination is needed that is capable of holding a multitude of tools, preserving perishable foods, and keeping chilled cold food and beverages. It is, therefore, to the provision of such an improvement that the present invention is directed.

BRIEF SUMMARY OF THE INVENTION

Briefly described, in a preferred embodiment, the present invention overcomes the above-mentioned disadvantages by providing a device capable of acting as both a toolbox and a cooler.

The present invention, in a preferred embodiment, comprises a tool box section and a cooler section integrally formed as one device. The toolbox portion, generally, is a typical tool box having a plurality of stacking tool trays with a latching means for securing said trays together. The stacked and latched tool trays thereby form the upper portion of the toolbox section. The lower portion forms, generally, a rectangular box having an open face and a generally half open top. Carried by approximately half of the lower portion, in the open top area, are a plurality of sliding tool drawers, well known within the art of toolboxes, that slide open through the open face of the lower portion of the toolbox section.

Carried by approximately the other half of the lower portion is the cooler section. The cooler section is made of any of a variety of well-known insulating materials, such as STYROFOAM®, and is encased in a plastic or metal material to increase the durability of the cooler section. The cooler section comprises a hinged lid having a cavity opposite the hinged end for inserting fingers to facilitate lifting of the lid. The cooler section slides in and out of the lower portion via a well-known means such as a tongue-and-groove, protrusion-and-track, or wheel-and-track arrangement. In addition, the cooler section is secured in the lower portion by any of a variety of well-known means such as dimples or recessed areas positioned at the end of the tongue-and-groove, protrusion-and-track, or wheel-and-track arrangements; thereby, requiring additional force to overcome the dimpled or recessed area. In order to insert and remove the cooler section, a protruding or recessed handle is formed on the exterior face wall of the cooler.

In a first alternate embodiment, the trays that form the upper portion of the toolbox section are sliding trays similar in function to the lower section sliding trays.

In a second alternate embodiment, the toolbox is a tackle box having pivotally raising multi-tiered trays. The cooler section is dimensioned to fit inside the lower portion of the tackle box underneath the multi-tiered trays. The lid of the tackle box is removably latched. In a third alternate embodiment, the lid is hinged to the tackle box. The lid of the cooler portion of both the second and third alternate embodiments comprises recessed hinged legs that allow the lid to be used as an extended work surface or food tray for eating. One side of the lid of the cooler comprises hooks or other means for securing that side to the tackle box while the other side is supported by hinged legs or in an alternate embodiment, both sides of the lid have hinged legs for supporting the lid in a free standing position. Note that the cooler as described in these embodiments may also be utilized in the toolbox embodiments described above.

In a fourth alternate embodiment, the first upper tray of the preferred embodiment is molded or otherwise formed and dimensioned to snugly and securely receive a typical drill and/or other tools.

A feature and advantage of the present invention is to provide a new and improved combination toolbox/cooler device that eliminates the need to carry both a separate toolbox and a cooler.

Another feature and advantage of the present invention is provide a new and improved combination toolbox/cooler device that is capable of holding tools and keeping food and beverages cold.

Another feature and advantage of the present invention is to provide a new and improved combination toolbox/cooler device having means for removably attaching a cooler to a toolbox.

Another feature and advantage of the present invention is to provide a new and improved combination toolbox/cooler device wherein the lid of the cooler comprises hinged legs such that the lid may be used as an additional work table or food and beverage table when removed from the cooler.

Another feature and advantage of the present invention is to provide a new and improved combination toolbox/cooler device having the upper tray molded or otherwise formed and dimensioned for snugly receiving an electric drill and/or other tools.

These and other objects, features and advantages of the invention will become more apparent to one skilled in the art from the following description and claims when read in light of the accompanying drawings.

BRIEF DESCRIPTION OF THE FIGURES

The present invention will be better understood by reading the Detailed Description of the Preferred Embodiment and Alternate Embodiments with reference to the accompanying drawing figures, in which like reference numerals denote similar structure and refer to like elements throughout, and in which.

DETAILED DESCRIPTION OF THE PREFERRED AND ALTERNATE EMBODIMENTS

In describing the preferred and alternate embodiments of the present invention illustrated in the Figures, specific terminology is employed for the sake of clarity. The invention, however, is not intended to be limited to the specific terminology so selected, and it is to be understood that each specific element includes all technical equivalents which operate in a similar manner to accomplish a similar purpose.

Figure 1:
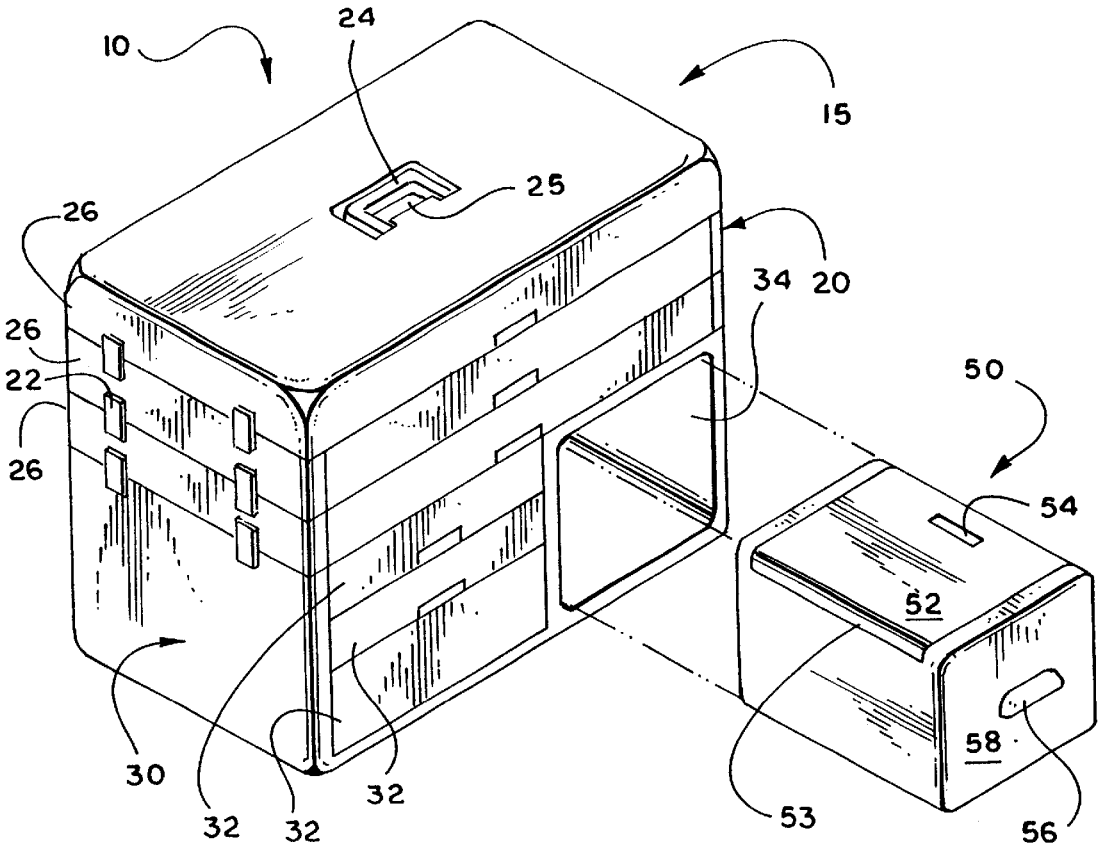
FIG. 1 is a perspective view of the present invention according to a preferred embodiment.

Referring now to FIG. 1, device 10 generally comprises toolbox section 15 and cooler section 50. More specifically, toolbox section 15 comprises upper portion 20 and lower portion 30. Upper portion 20 of toolbox section 15 is defined by a plurality of stacking trays 26, well known within the art, having recessed areas for storing tools. Each stacking tray 26 is latched to the adjacent tray by well known overhang latches 22 with the lower-most of stacking trays 22 being latched to the lower portion 30 of toolbox section 15. To facilitate the lifting of device 10, handle 24, pivotally contained within recessed area 25, is attached, generally at the center of the upper most of stacking trays 22. Handle 24 is well known within the art.

Lower portion 30 of toolbox section 15 is generally a rectangular box with an open face and a generally half open top. Comprising approximately the vertical half of lower portion 30 are a plurality of sliding trays 32, well known within the art. The other approximately vertical half of lower portion 30 defines generally rectangular channel 34 dimensioned for receiving cooler section 50.

Cooler section 50 is generally rectangular box shaped having five walls and lid 52. Lid 52 is hinged 53 to one of the side walls and has cavity 54 opposite hinge 53 for inserting fingers to facilitate lifting of lid 52. Formed on the front wall 58 of cooler section 50 is handle 56 to facilitate insertion and removal of cooler section 50 into toolbox section 15 through channel 34.

The cooler section 50 is made of any of a variety of well-known insulating materials, such as STYROFOAM®, and is encased in a plastic or metal material to increase the durability of the cooler section. The cooler section 50 comprises a hinged lid having a cavity opposite the hinged end for inserting fingers to facilitate lifting of the lid. The cooler section slides in and out of the lower portion via a well-known means such as a tongue-and-groove, protrusion-and-track, or wheel-and-track arrangement. In addition, the cooler section is secured in the lower portion by any of a variety of well-known means such as dimples or recessed areas positioned at the end of the tongue-and-groove, protrusion-and-track, or wheel-and-track arrangements; thereby, requiring additional force to overcome the dimpled or recessed area. In order to insert and remove the cooler section, a protruding or recessed handle 56 is formed on the exterior face wall of the cooler. Although not shown in the Figures, it will be appreciated by one ordinarily skilled in the art that the other approximately vertical half of lower portion 30 may define a built in cooler section 50.

Figure 2:
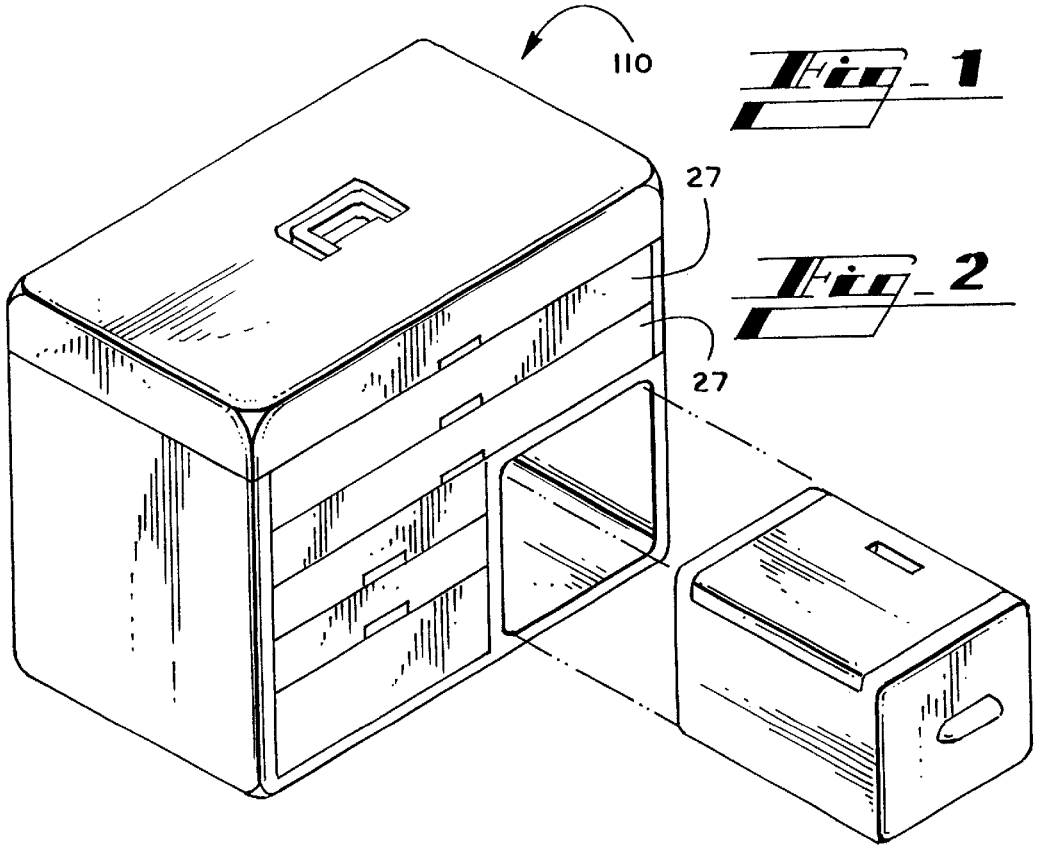
FIG. 2 is a perspective view of the present invention according to a first alternate embodiment.

Now referring to FIG. 2, it is shown that in the first alternate embodiment, sliding tool trays 27 are utilized in lieu of stacking tool trays 26 of the preferred embodiment of FIG. 1.

Figure 3:
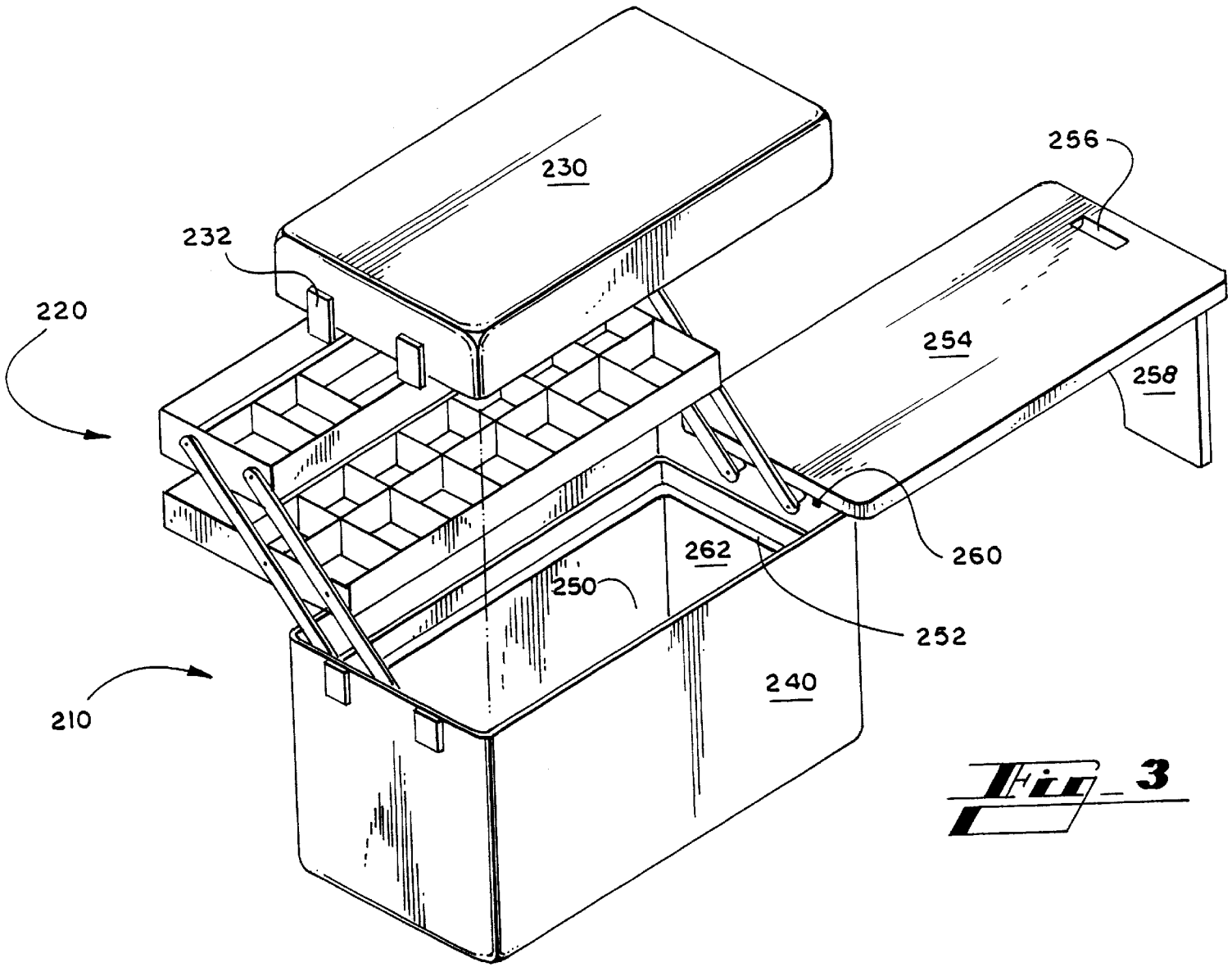
FIG. 3 is a perspective view of the present invention according to a second alternate embodiment.

Now referring to FIG. 3, a second alternate embodiment is shown as device 210. Device 210 is generally a tackle box comprising multi-tiered trays 220, lid 230, and cooler section 250. Multi-tiered trays 220 are pivotally attached to box portion 240 of device 210 such that multi-tiered trays 220 are stacked directly over each other when in the closed position and staggered to allow access to all trays when in the open position. Lid 230 of device 210 lifts off of device 210 and is secured on device 210 by well-known overhang latches 232. Contained under multi-tiered trays 220 and defined by rectangular box portion 240 of device 210 is cooler section 250. Insulating material 262 lines the interior of rectangular box portion 240 thereby forming lip 252. Dimensioned to rest on lip 252 is cooler lid 254. Preferably, spring hinged to the bottom surface at one end of cooler lid 254 and approximately the width of cooler lid 254 is leg 258. When cooler lid 254 is placed on lip 252, leg 258 also makes contact with lip 252 thereby hinging leg 258 to the closed position resting generally against and parallel to cooler lid 254. In the open position, leg 258 is urged away from cooler lid 254 to a generally perpendicular position relative to cooler lid 254. The other end of cooler lid 254 has well known hooks 260 for attaching to box portion 240 of device 210. It should be noted that slits dimensioned for receiving the edge of the side wall of box portion 240 may be formed in the side wall of cooler lid 254 in lieu of hooks 260.

Figure 4:
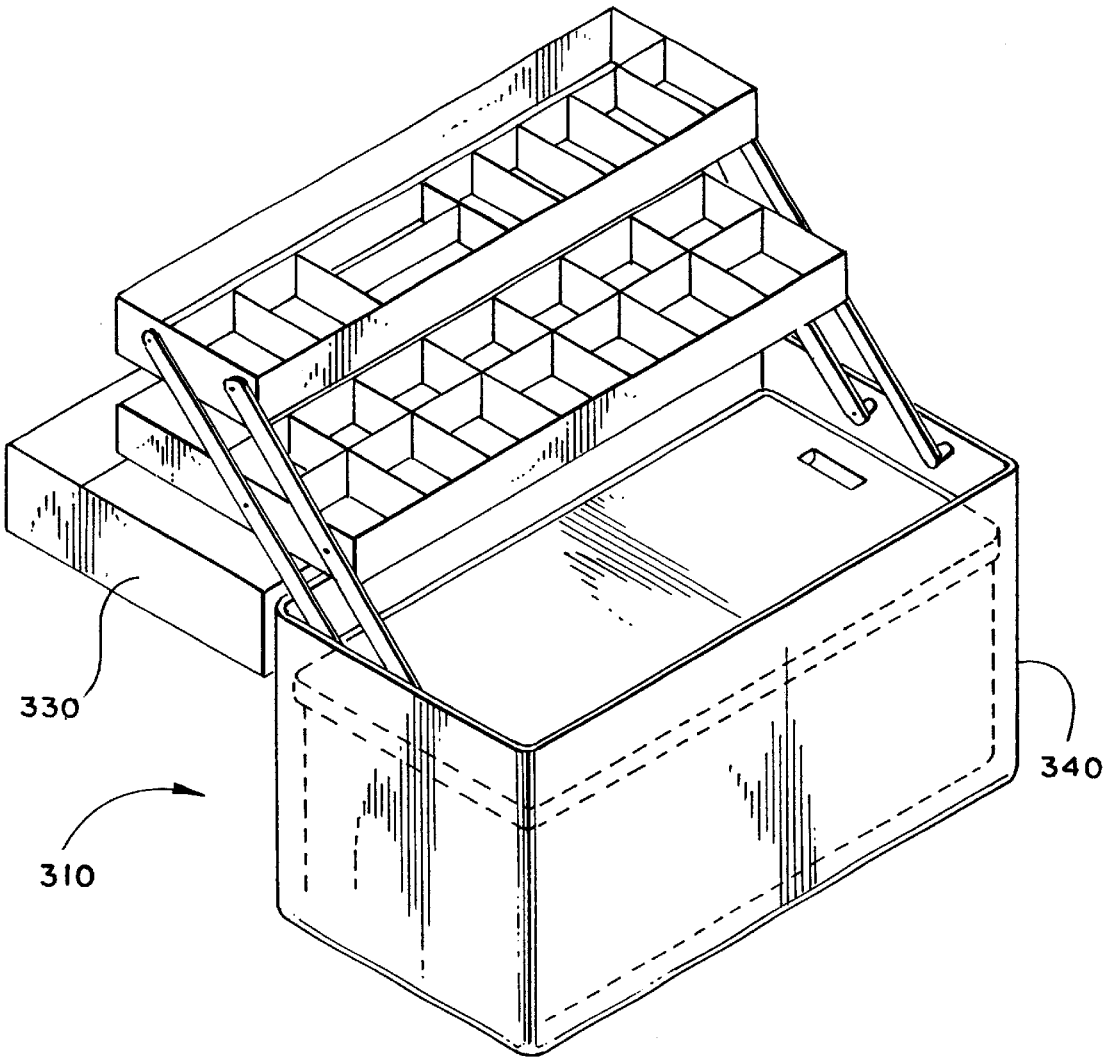
FIG. 4 is a perspective view of the present invention according to a third alternate embodiment; and, FIG. 5 is a perspective view of the present invention according to a fourth alternate embodiment.

Now referring to FIG. 4, there is shown a third alternate embodiment delineated as device 310 which is identical to second alternate embodiment 210 of FIG. 3 except that lid 330 of device 310 is hinged to box portion 340.

Figure 5:
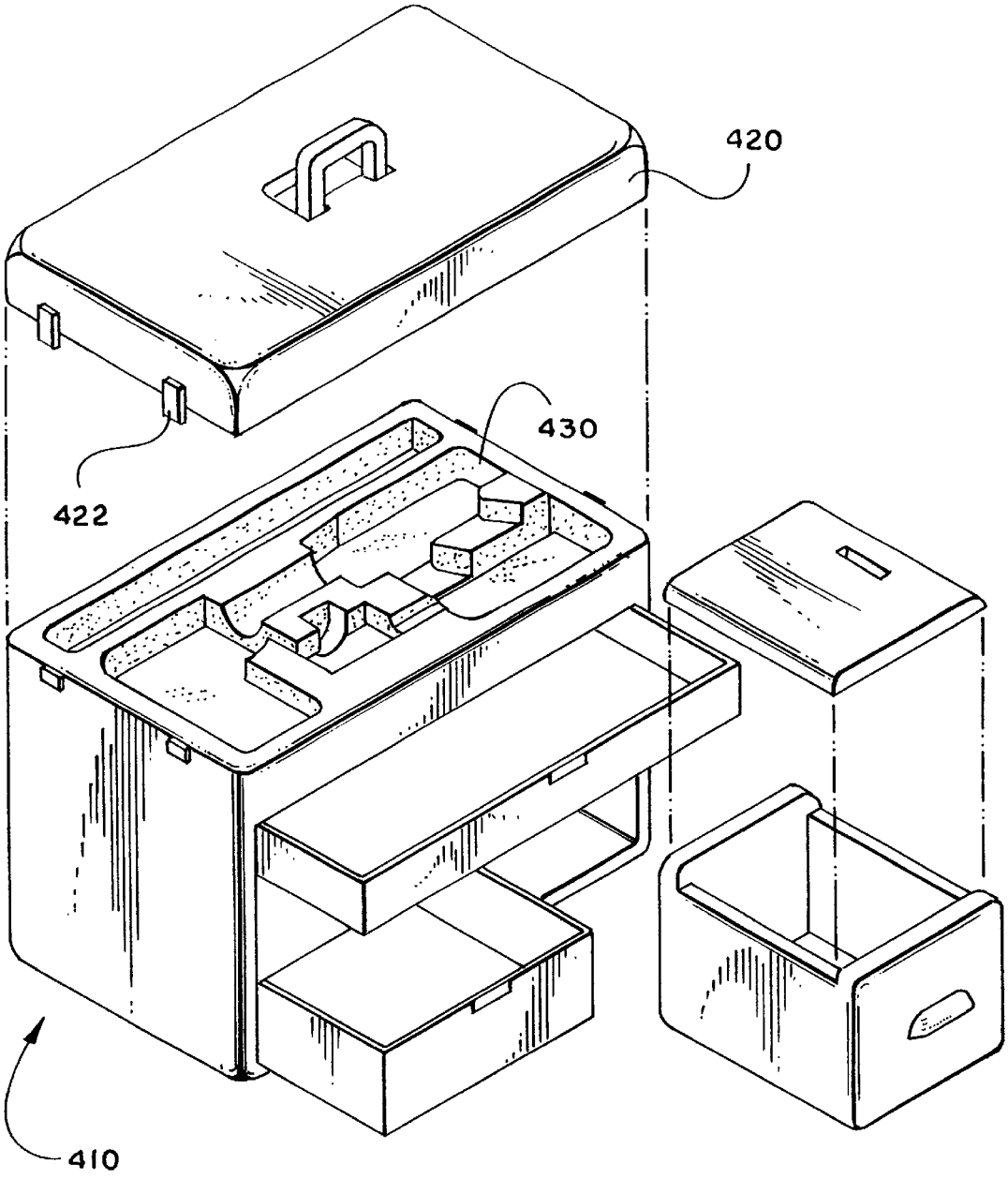

Now referring to FIG. 5, there is shown a fourth alternate embodiment delineated as device 410 which is identical to first alternate embodiment 110 except as follows. Device 410 comprises lid 420 and molded tray 430. Lid 420 is secured to device 410 by overhang latches 422. Molded tray 430 is formed to allow a snug fit of various electric drills and tools. Molded tray 430 can be an insert sold separately and dimensioned to hold specific models of various name-brand drills and/or power tools.

It should be noted that device 10, 110, 210, 310, and 410 may be made from plastic material to reduce the weight or from metal material to increase the stiffness and durability. Additionally, a locking bar or locking means, well known within the art, may be utilized with all embodiments.

It should be apparent to one ordinarily skilled in the art that the present invention is not limited to the exemplary configurations herein specified. For example, the cooler portion may be provided in a form which allows it to be opened from the front, rather than from the top. Additionally, a support table, similar in form and function to that provided in the exemplary embodiments as cooler lid 254, may be provided as a separate element adjacent to and under one tool tray. The cooler portion may be removeable and replaceable with an equivalently sized chamber for tools. The entire device may be provided with handles and rollers well-known in the art to facilitate moving and transporting the device.

Thus, the above detailed description of the preferred and alternate embodiments of the present invention are for exemplary purposes only and are not meant to limit the scope or spirit of the invention as defined by the appended claims.

What is claimed is:

1. A combination toolbox-cooler for carrying tools and for reducing temperature loss and gain to food and beverages, comprising:

a toolbox portion; and, a cooler portion, said cooler portion being carried by said toolbox portion.

2. The device of claim 1 further comprising a plurality of trays for carrying tools, said plurality of trays carried by said toolbox portion.

3. The device of claim 2, wherein said plurality of trays comprises at least two removably stacked trays.

4. The device of claim 2, wherein said plurality of trays comprises at least one slidably engaged tray.

5. The device of claim 2 further comprising means for securing said plurality of trays together.

6. The device of claim 5, wherein said securing means is a latch.

7. The device of claim 1, wherein said cooler portion is slidably engaged with said toolbox portion.

8. The device of claim 1 further comprising a handle attached to said toolbox portion for carrying said device.

9. The device of claim 1, wherein at least one of said plurality of trays is molded in dimension to receive a power tool.

10. A combination tackle box-cooler for carrying tackle and for reducing temperature loss and gain to food and beverages, comprising:

a tackle box, said tackle box having a plurality of tiered trays carried by said tackle box; and, a cooler portion, said cooler portion being defined by said tackle box.

11. The device of claim 10 further comprising a removable cooler lid having a first end and a second end dimensioned to fit over said cooler portion.

12. The device of claim 11 further comprising a hinged leg carried by said cooler lid at said first end, wherein said hinged leg can be extended to a position that is perpendicular to said cooler lid when said cooler lid is removed from said cooler portion, and wherein said second end of said cooler lid can rest against said tackle box for supporting said cooler lid in a generally horizontal position.

13. The device of claim 12 further comprising at least one hook carried by said cooler lid at said second end for removably securing said second end to said tackle box for supporting said cooler lid in a generally horizontal position.

14. The device of claim 11 further comprising a first hinged leg carried by said cooler lid at said first end and a second hinged leg carried by said cooler lid at said second end, wherein said first hinged leg and said second hinged leg can be extended to a position that is perpendicular to said cooler lid when said cooler lid is removed from said cooler portion, thereby supporting said cooler lid in a generally horizontal position.

* * * * *